US005439065A

United States Patent [19]

Georgi

[11] Patent Number: 5,439,065

[45] Date of Patent: Aug. 8, 1995

[54] ROTARY SIDEWALL SPONGE CORING APPARATUS

[75] Inventor: Daniel T. Georgi, Houston, Tex.

[73] Assignee: Western Atlas International, Inc., Houston, Tex.

[21] Appl. No.: 314,247

[22] Filed: Sep. 28, 1994

[51] Int. Cl.[6] ..... E21B 49/00

[52] U.S. Cl. ..... 175/59; 175/226; 175/236; 175/249

[58] Field of Search ..... 175/58, 59, 226, 236, 175/249; 166/250

[56] References Cited

U.S. PATENT DOCUMENTS

| | | | |
|---|---|---|---|
| 4,354,558 | 10/1982 | Jageler et al. | 175/58 X |
| 4,466,495 | 8/1984 | Jageler | 175/59 |
| 4,479,557 | 10/1984 | Park et al. | 175/59 |
| 4,502,553 | 3/1985 | Park et al. | 175/59 |
| 4,598,777 | 7/1986 | Park et al. | 175/58 |
| 4,716,974 | 1/1988 | Radford et al. | 175/59 |
| 4,787,983 | 11/1988 | Difoggio et al. | 166/250 X |
| 5,310,013 | 5/1994 | Kishino et al. | 175/58 X |
| 5,360,074 | 11/1994 | Collee et al. | 175/58 |

OTHER PUBLICATIONS

Brochure on "DPS Sponge Coring System Squeezes Twice As Much As Oil Saturation Data From Your Budget", Diamant Boart Stratabit (printed in 1988).

*Primary Examiner*—Roger J. Schoeppel

*Attorney, Agent, or Firm*—Richard A. Fagin

[57] ABSTRACT

The invention is an apparatus for rotary drilling of core samples from the wall of a wellbore. The apparatus comprises a coring bit, a motor, a bit box rotatably mounted within a housing adapted to traverse the wellbore, a plunger for extracting the core sample from the bit and discharging the core sample into a storage barrel which has a sponge liner. The sponge liner in the barrel adsorbs liquid hydrocarbons which may be expelled from the porosity in the core sample by gas exsolution.

9 Claims, 3 Drawing Sheets

ROTARY SIDEWALL SPONGE CORING APPARATUS

CROSS REFERENCE TO APPLICATIONS

U.S. Patent application Ser. No. 08/146,441 now U.S. Pat. No. 5,411,106 assigned to the assignee of the present invention contains subject matter which relates to the present invention.

BACKGROUND OF THE INVENTION

1. Field of the Invention

The invention is related to the field of drilling and analyzing of core samples from a wellbore penetrating earth formations. More specifically, the invention is related to the use of synthetic sponge liners in a core sample storage chamber for capturing, and preventing loss, of liquid hydrocarbons which may be present in the core sample during transport of the core sample to the earth's surface from the depth within the wellbore at which the sample was drilled.

2. Discussion of the Related Art

Core samples are typically drilled from a rotary drilling rig, in a predetermined earth formation which will eventually be penetrated by a wellbore. The core samples are used to obtain data concerning rock composition, porosity type and volume, and fluid content within the pore space in the formation.

In order to drill the core sample, drilling the wellbore must stop near the top of the predetermined formation, and a drilling assembly is replaced with a coring assembly. The coring assembly typically includes a coring bit, which comprises an annular cylindrical cutting surface. The cutting surface has a hollow center which captures a cylindrical section of the predetermined formation which is formed as a result of the coring bit penetrating the formation. When the hollow center of the coring bit is filled with the core sample, the coring bit is brought to the earth's surface to retrieve the core sample for analysis.

The wellbore is typically drilled using a fluid called drilling mud, which is used to maintain hydrostatic pressure against a fluid pressure which can be present in the pore space of certain earth formations. The mud also maintains the mechanical stability of the open wellbore. In order to maintain hydrostatic pressure, the drilling mud can have a density which is equivalent to a fluid having a pressure gradient ranging from 0.5 to as much as 1.2 psi per foot of wellbore depth. As the core sample is brought to the earth's surface from deeper in the wellbore, fluids contained in pore spaces in the core sample can be expelled from the pore spaces by exsolution of gas. Exsolution results from decreasing hydrostatic pressure on the core sample as the core sample is brought to the earth's surface.

In core samples which contain some amount of petroleum, it is very common for gas dissolved in liquid hydrocarbon to come out of solution as the external hydrostatic pressure is reduced, and as a result, liquid hydrocarbon contained in the pore space can be expelled from the pore space. If the core sample had been intended for obtaining information about possible petroleum content, the loss of liquid hydrocarbon could compromise the analysis.

It is known in the art to provide a sponge liner within the coring bit to capture liquid hydrocarbons which may be displaced by exsolution of gas during recovery of the core sample. For example, "DBS Sponge Coring System", Diamant Boart Stratabit, Houston, Tex. 1988, describes a coring bit having an integral polyurethane sponge liner which absorbs liquid hydrocarbons which may be displaced from the pore space in the core sample.

One of the limitations of using the drilling rig to drill the core sample is that the depth of the predetermined formation may not be precisely known before the wellbore is drilled. Therefore it is difficult to determine the precise depth at which to stop drilling and attach the coring assembly.

In geographic areas in which knowledge about the earth formations is limited, it may not be known prior to drilling the wellbore which formations would provide useful data from the core sample. There may also be a plurality of earth formations in a particular wellbore in which core samples could provide valuable information. It is sometimes uneconomical to drill a plurality of core samples by using the drilling rig in a particular wellbore.

It is known in the art to obtain core samples from the wall of the wellbore after the wellbore has been drilled. Typically, the wellbore will be surveyed with at least one well logging instrument to determine, among other things, from which formations a core sample would likely provide useful information from.

An instrument for rotary drilling core samples from the wellbore wall, the core samples so drilled being known as sidewall cores, is known in the art. For example, "The Rotary Sidewall Coring Tool", Atlas Wireline Services, Houston, Tex., 1993, describes an instrument that can drill a plurality of core samples at any depths within the wellbore chosen by the operator.

The instrument known in the art for taking rotary drilled sidewall cores uses a receiving barrel, disposed within the instrument housing, for storing the core samples until the instrument is brought to the earth's surface. The receiving barrel is in hydraulic communication with the wellbore, so that as the instrument is brought to the earth's surface for recovery of the core samples, any liquid hydrocarbon which may be present in the pore space of the core samples can be driven out of the pore space by exsolution of gas, in substantially the same way as in core samples drilled by using the drilling rig. Analysis of the original liquid hydrocarbon content of the core samples could be compromised.

It is an object of the present invention to provide a sidewall coring tool which stores a plurality of core samples in an absorbent sponge liner so that liquid hydrocarbons which may be driven out of the core samples will be captured by the sponge liner for later analysis.

SUMMARY OF THE INVENTION

The present invention is an apparatus for rotary drilling at least one core sample from the wall of a wellbore penetrating an earth formation. The apparatus comprises an elongated housing adapted for traversing the wellbore, a retractable rotary coring bit, a bit box rotatable mounted in the housing, a motor to drive the bit, and a receiving barrel comprising a sponge liner which absorbs liquid hydrocarbon which may be displaced from the pore space in the core sample by dissolved gas exsolution as the apparatus is brought to the earth's surface from deeper in the wellbore. The core samples are pushed from the bit into the barrel by means of a plunger.

DESCRIPTION OF THE PREFERRED EMBODIMENT

Figure 1:
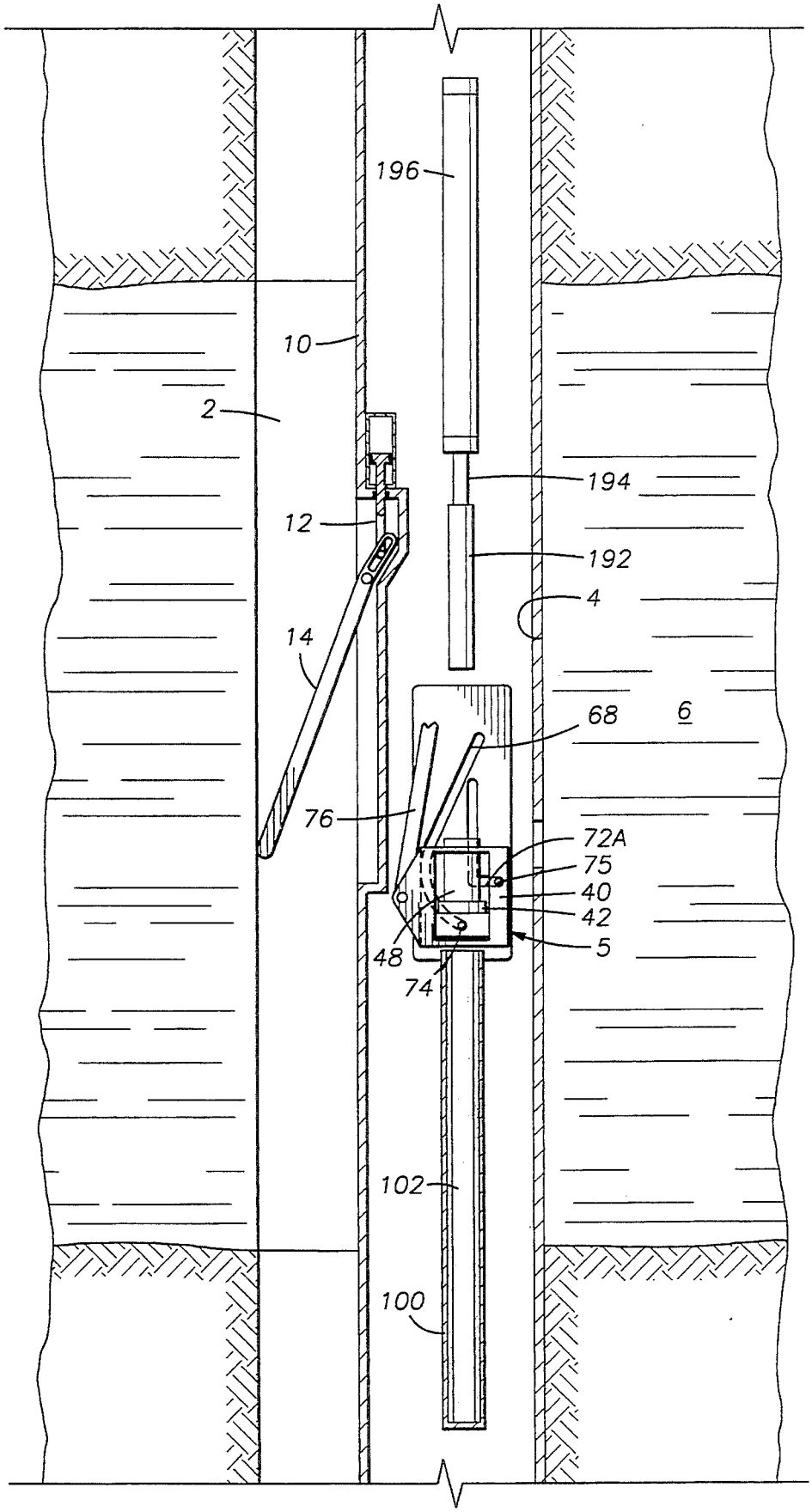
FIG. 1 shows the major functional components of the invention.

FIG. 1 shows the major functional components of the invention. A rotary sidewall coring instrument 5 is contained in a housing 10 which is adapted to traverse a wellbore 2. The housing 10 is connected to an electrical wireline (not shown) for supply of electrical power, communication of signals to control equipment (not shown) at the earth's surface, and conveyance of the instrument 5 to a formation 6 of interest in the wellbore 2. The housing 10 can be conveyed to the formation 6 of interest by coiled tubing (not shown) or drillpipe (not shown) as well as by wireline.

When the formation 6 has been reached in which a core sample (shown as 24 in FIG. 2) is to be drilled, a backup arm 14 attached to the housing 10 is extended by actuating a linkage 12. The back-up arm 14 pushes the face of the housing 10 opposite the arm 14 into contact with the wall 4 of the wellbore 2, so that a core bit 48 can come into contact with the formation 6 with only a minimum amount of extension from a bit box 40 in which the bit 48 is disposed.

The bit box 40 provides rotational support for the bit 48, and is rotatably mounted inside the housing 10 so that the bit 48 can either be substantially in axial alignment with the housing 10 during core extraction and movement of the housing 10 in the wellbore 2, or be substantially perpendicular to the housing 10 so that the formation 6 can be drilled from the wall 4 of the wellbore 2 by the bit 48.

Figure 2:
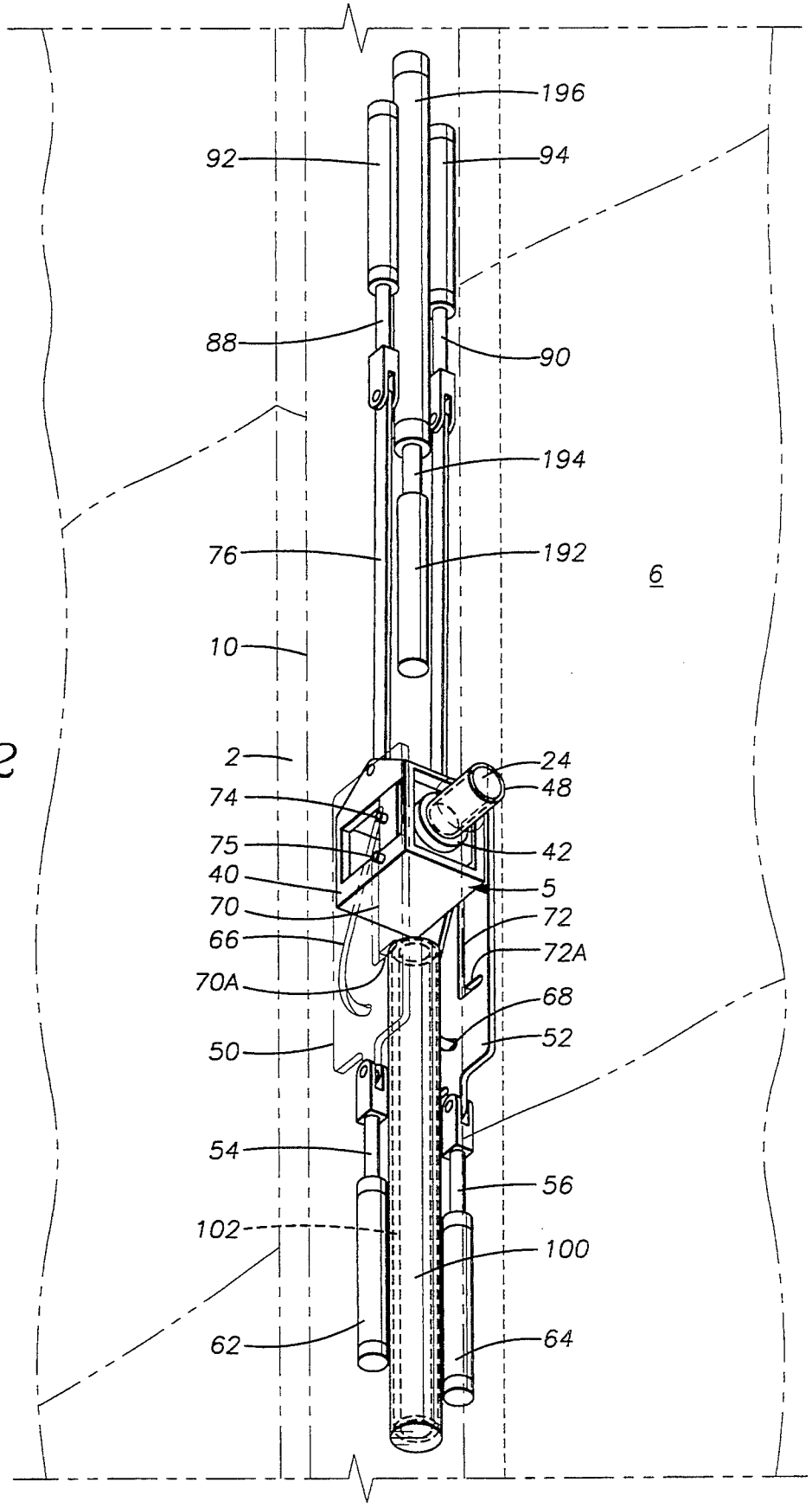
FIG. 2 shows the core cutting mechanism within the instrument housing in detail.

FIG. 2 shows the section of the instrument 5 used for drilling and storing the core samples 24 in more detail. The bit box 40 is shown positioned so that the coring bit 48 is substantially perpendicular to the axis of the housing 10, enabling the core sample 24 to be drilled.

The bit box 40 is mounted on first hinge pins 74 and second hinge pins 75 which slide in slots 66, 68, 70, 72 in control brackets 50, 52 disposed on either side of the bit box 40. The brackets 50, 52 can be made to move substantially coaxially with the housing 10 by means of hydraulic cylinders 62, 64 and push rods 54, 56.

The vertical position of the bit box 40 within the housing 10 is controlled by a linkage 76 which moves substantially coaxially within the housing 10 by means of additional hydraulic cylinders 92, 94 and additional push rods 88, 90. Movement of the additional pushrods 92, 94 in a downward direction causes the bit box 40 to move relative to the brackets 50, 52, which causes the second hinge pins 75 to slide in the slots 70, 72 until the second hinge pins 75 reach the lower angled sections 70A, 72A of the slots 70, 72.

When the bit 48 is rotated to be perpendicular to the housing 10, axial thrust for the bit 48 is provided by moving the brackets 50, 52 downward while maintaining the vertical position of the bit box 40. Retraction of the hydraulic cylinders 62, 64 causes the slots 66, 68 on the brackets 50, 52 to move relative to the first hinge pins 74. The relative motion of the first hinge pins 74 in the slots 66, 68 causes the pins 74 to be moved in the direction of the outer surface of the housing 10. The pins 74 are coupled to the bit 48 so as to force the bit 48 to move towards the wall 4 of the borehole 2. The motor 42 turns the bit 48 to enable cutting of the formation 6. Axial thrust is maintained on the bit 48 as the formation 6 is penetrated by the bit 48, by continuously applying retraction from the hydraulic cylinders 62, 64, until the bit 48 is completely extended and a core sample 24 is completely drilled.

After a core sample 24 is drilled, the hydraulic cylinders 62, 64 are extended so that the bit 48 retracts into the bit box 40. The additional hydraulic cylinders 92, 94 are actuated so that when the hinge pins 75 reach the lower angled sections 70A, 72A, of the brackets 50, 52 the bit box 40 is forced to rotate so that the axis of the coring bit 48 is rotated substantially into axial alignment with the housing 10.

When the bit box 40 is substantially in axial alignment with the housing 10, a plunger 192 can be pushed through the core bit 48 so that a core sample (shown as 24 in FIG. 2) can be ejected into a receiving barrel 100 disposed below the bit box 40. The barrel 100 comprises a sponge liner 102. The plunger 192 is actuated by a piston 194 driven by an hydraulic cylinder 196. The plunger 192 should be of sufficient length to be able to push the core sample 24 to the lowest available position in the barrel 100, so that the core sample 24 remains in contact with the same portion of the sponge liner 102 during the continued operation of the instrument 5, which may include drilling of additional core samples 24 during a particular continuous operation in the wellbore 2.

Another core sample 24 can be drilled at a different depth of interest in the wellbore 2 after resetting the bit box 40 until it is substantially perpendicular to the housing 10, by retracting the additional hydraulic cylinders 92, 94, moving the instrument 5 to the new depth if interest, and repeating the setting and drilling operation previously described.

A plurality of core samples 24 can be obtained in one trip into the wellbore 2 with the instrument 5 by making the barrel 100 long enough to hold the plurality of core samples 24. After each core sample 24 is drilled, that core sample 24 is pushed to the lowest remaining position in the barrel 100. The core samples 24 can later be identified as to the depth at which they were taken by their ordinal position in the stack of core samples thus formed in the barrel 100.

The drilling and extraction process can be repeated for each core sample 24 until a desired number of core samples 24 are drilled, whereupon the instrument 5 is returned to the earth's surface for recovery of the core samples 24.

Sensors (not shown) can be attached to the hydraulic cylinders 62, 64, 92, 94, 196, and the motor 42 to measure the relative position of each hydraulic cylinder and force applied by each cylinder and the torque applied by the motor 42. The measurements made by the sensors can be transmitted to equipment (not shown) at the earth's surface by a data transmission unit (not shown) disposed in the housing 10 for display and interpretation. The equipment at the earth's surface and the data transmission unit can be of a type known in the art.

The measurements are used particularly to determine the rotational and extensional positions of the bit box, and the drilling power applied to the formation 6, so that an accurate assessment of the completion of drilling and recovery into the barrel 100 of a particular core sample 24 can be made.

Figure 3:
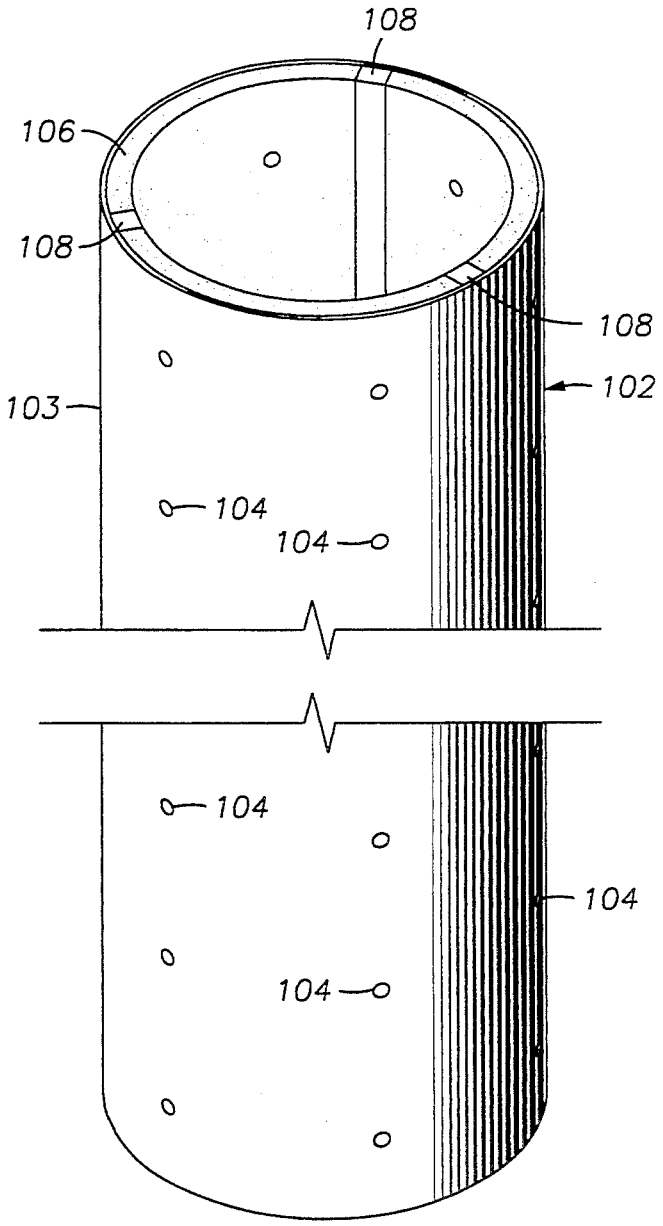
FIG. 3 shows the construction of the sponge liner which is disposed within the receiving barrel.
Figure 4:
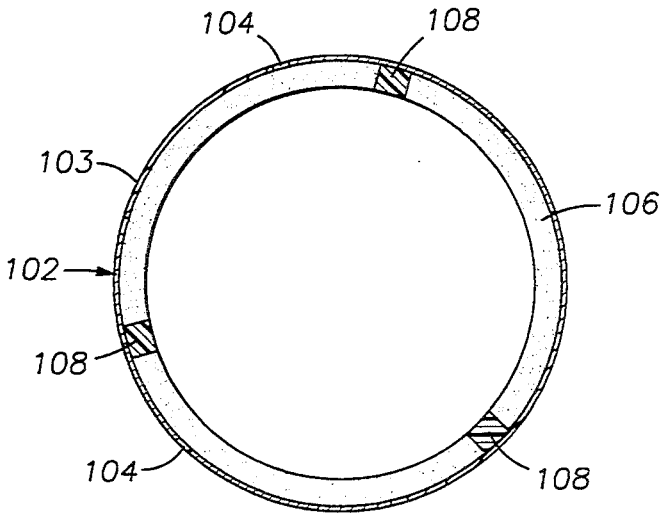
FIG. 4 is a cross-sectional view of FIG. 3

FIG. 3 shows the construction of a sponge liner 102 disposed inside the receiving barrel (shown as 100 in FIG. 2).

The sponge 106 can be composed of a high porosity polyurethane foam which is preferentially wetted by oil. Use of polyurethane foam for containment of cores is known in the art. For example "DBS Sponge Coring System", Diamant Boart Stratabit, Houston, Tex. 1988 describes the composition of a foam which has been used successfully for recovering oil which may be expelled from core samples brought to the earth's surface from within a wellbore.

The sponge 106 is covered on its external surface by a perforated metal sleeve 103 which maintains the shape and mechanical integrity of the sponge 106 as it is removed from the barrel (shown as 100 in FIG. 2) for analysis. The sleeve 103 has a number of holes 104 each of about 1/16 inch diameter to enable exsolved gas and displaced water to exit the sponge 106. Ribs 108, which in this embodiment can be composed of Teflon or similar low-friction solid material, position the core samples (shown as 24 in FIG. 2) centrally within the sponge 106 so that the plunger (shown as 192 in FIG. 2) can move the core samples 24 freely to the lowest position in the barrel 100.

It is desirable to pre-fill the porosity in the sponge 106 with water before running the instrument 5 in the wellbore 2, so that solids from drilling mud (not shown) which are likely to be present in the wellbore 2 will not be forced into the porosity of the sponge 106 by differential pressure when the instrument 5 is lowered into the wellbore. Drilling mud solids can adversely affect the permeability of the sponge 106, which may impede movement of displaced oils from the core sample 24 into the sponge 106.

In the event the wellbore 2 is drilled with a fluid (not shown) having a continuous liquid phase composed a non-polar solvent such as light hydrocarbon, this type of fluid commonly known as "oil-based mud", then it may be desirable to use a sponge 106 comprising a preferentially water-wet material in order to accurately determine the connate water saturation in the formation 6 penetrated by the wellbore 2.

I claim:

1. An apparatus for rotary drilling at least one core sample from the wall of a wellbore penetrating an earth formation, the apparatus comprising:

an elongated housing, adapted for traversing the wellbore;

a bit box, rotatably mounted within the housing;

a rotary coring drill bit rotatably and extensibly mounted within the bit box;

a motor, disposed within the housing, rotationally coupled to the bit;

a first linkage, disposed within the housing, the first linkage cooperatively attached to the bit box to rotate the bit box so that the bit moves from being substantially in axial alignment with the housing to being substantially perpendicular to the housing;

a second linkage rotatably coupled to the bit and movably coupled to the bit box, the second linkage for extending the bit axially out of the bit box, so that force is applied by the bit against the wall of the wellbore;

an elongated receiving barrel disposed within the housing on one side of the bit box, the barrel substantially in axial alignment with the housing;

an elongated, core extracting plunger disposed within the housing on the other side of the bit box, the plunger extendible to push the at least one core sample out of the bit into the receiving barrel when the bit box is positioned so that the bit is substantially in axial alignment with the housing; and a sponge liner, disposed within the receiving barrel, the sponge liner substantially filling an annular space between the inner wall of the barrel and the external diameter of the at least one core sample, the sponge liner substantially in hydraulic communication with the core sample, so that fluids escaping from pore spaces within the at least one core sample are substantially absorbed by the sponge liner.

2. The apparatus as defined in claim 1 wherein the sponge liner further comprises:

an annular cylinder composed of a permeable foamed plastic;

a perforated metal sleeve covering the exterior of the annular cylinder; and at least three solid ribs positioned in the annular cylinder radially spaced apart and positioned to contact the sleeve on one side of each rib and the at least one core sample on the opposite side of each rib, each rib having a thickness substantially the same as the thickness of the annular cylinder, and each rib having a length substantially the same as the length of the annular cylinder, to enable movement of the at least one core sample through the annular cylinder with minimal friction.

3. The apparatus as defined in claim 2 wherein the annular cylinder further comprises a preferentially oil-wet foamed plastic.

4. The apparatus as defined in claim 2 wherein the annular cylinder further comprises a preferentially water-wet foamed plastic.

5. The apparatus as defined in claim 1 wherein the motor further comprises an hydraulic motor.

6. The apparatus as defined in claim 1 further comprising a first hydraulic cylinder operatively connected to the linkage.

7. The apparatus as defined in claim 1 further comprising a second hydraulic cylinder operatively connected to the plunger.

8. The apparatus as defined in claim 1 further comprising:

sensors which measure an amount of extension of the second linkage, torque applied by the motor to the bit, a rotational position of the bit box, pressure applied by the plunger to the core sample; and data transmission means for imparting electrical signals representing measurements made by the sensors to a cable connecting the housing to equipment at the earth's surface, the equipment for receiving and interpreting the signals for display and interpretation.

9. A method of obtaining at least one core sample from the wall of a wellbore penetrating an earth formation, the method comprising the steps of:

a) positioning a rotary sidewall coring apparatus adjacent to a formation of interest, the apparatus comprising a coring bit and a core receiving barrel having sufficient volume to store a plurality of core samples, the barrel comprising a sponge liner substantially filling an annular space between the core samples and an inner wall of the chamber, whereby fluids which escape from the core sample are substantially absorbed by the sponge liner;

b) drilling the core sample by activating the coring bit;

c) moving the core sample into the storage chamber.

* * * * *